US005395132A

United States Patent [19]

Abondance et al.

[11] Patent Number: 5,395,132

[45] Date of Patent: Mar. 7, 1995

[54] DEVICE FOR MOUNTING A RELEASE BINDING ON A SKI

[75] Inventors: Roger Abondance, La Murette; Laurent Boix Vives, Grenoble, both of France

[73] Assignee: Skis Rossignol S.A., Voiron, France

[21] Appl. No.: 28,929

[22] Filed: Mar. 8, 1993

[30] Foreign Application Priority Data

Mar. 10, 1992 [FR] France ..... 92 03193

[51] Int. Cl.[6] ..... A63C 9/08

[52] U.S. Cl. ..... 280/607; 280/616; 280/617

[58] Field of Search ..... 280/607, 609, 616, 617, 280/618, 633, 634, 602

[56] References Cited

U.S. PATENT DOCUMENTS 3,797,839 3/1974 Smolka et al. ..... 280/607
3,797,844 3/1974 Smolka et al. ..... 280/607
5,269,555 12/1993 Ruffinengo ..... 280/607

FOREIGN PATENT DOCUMENTS 2105801 4/1972 France .
2639242 5/1990 France .
3710092 10/1988 Germany .
9102551 7/1991 Germany .

*Primary Examiner*—Richard M. Camby
*Attorney, Agent, or Firm*—Oliff & Berridge

[57] ABSTRACT

A device to mount a release binding on a ski has a pair of blocks which are independent of one another. The blocks are mounted on the upper surface of a ski and the bindings are mounted on the pair of blocks. A connector connects the pair of blocks. The connector is inextensible and is mounted on the pair of blocks such that when the ski is flexed the connector prohibits the spreading of the pair of blocks while permitting the pair of blocks to approach toward one another.

13 Claims, 4 Drawing Sheets

DEVICE FOR MOUNTING A RELEASE BINDING ON A SKI

FIELD OF THE INVENTION

The goal of the present invention is to provide a device for mounting a release binding on a ski.

BACKGROUND OF THE INVENTION

Traditionally, a release binding is mounted on a ski directly in contact with the top surface of the ski. The evolution of ski manufacturing technology has resulted in skis, especially slalom skis, which are narrower in the "skate" area than before. The skate area serves to support a ski boot. The boot projects laterally to either side of the ski, which, on a steep slope, as a result of the contact between the boot and the snow prior to the corresponding edge of the ski, digs into the snow. This causes the ski to shift and possibly result in imbalance, causing the skier to fall.

To overcome this disadvantage, it has been suggested to raise the boot relative to the ski by interposing a plate between the ski and the boot, with the binding, toe piece, and heel piece being mounted on said plate. Apart from the fact that it increases the weight of the ski-binding assembly, this plate has the disadvantage of clamping the ski over the length of its contact with the ski. It is desirable for a ski to deform as freely as possible when it is used, to provide the best performance.

Another solution consists in equipping a ski with two independent blocks, each mounted on the top surface of the ski and serving to mount the toe piece and heel piece of the binding. This does not provide clamping action over the length of the binding area, as in the previous case. However, the distance of the toe piece and the heel piece from the surface of the ski is greater than that which is obtained with direct mounting on the ski. As well, there is an increase in the pressure of the boot on the binding which produces an increase in the tilting force of the binding. This tilting force translates to an increase in the camber or flexing of the ski which changes the behavior of the ski.

SUMMARY OF THE INVENTION

A goal of the invention is to provide a device for mounting on a ski, which has a toe piece and a heel piece of the binding mounted on elevating blocks without this elevation resulting in an increase in the flexing of the ski.

For this purpose, the device in accordance with the instant invention, is of the type having two blocks mounted on the ski and serving to hold the toe piece and the heel piece of the binding. The device further has a connector between the two blocks. The connector is inextensible and therefore prevents the spreading of the two blocks, while permitting them to approach one another.

Thus, when a boot is fastened to a ski in accordance with the instant invention, the torque exerted by the toe piece and the heel piece is transformed into limited deformation of the ski because of the action of the inextensible connector which connects the blocks supporting the toe piece and the heel piece. This connector avoids adversely affecting the flexing and the behavior of the ski previously associated with clamping in the "skate" area. In accordance with the present invention, the toe piece and heel piece can approach one another as a result of the deformation of the ski as it passes through a hollow.

DETAILED DESCRIPTION OF PREFERRED EMBODIMENTS

Figure 1:
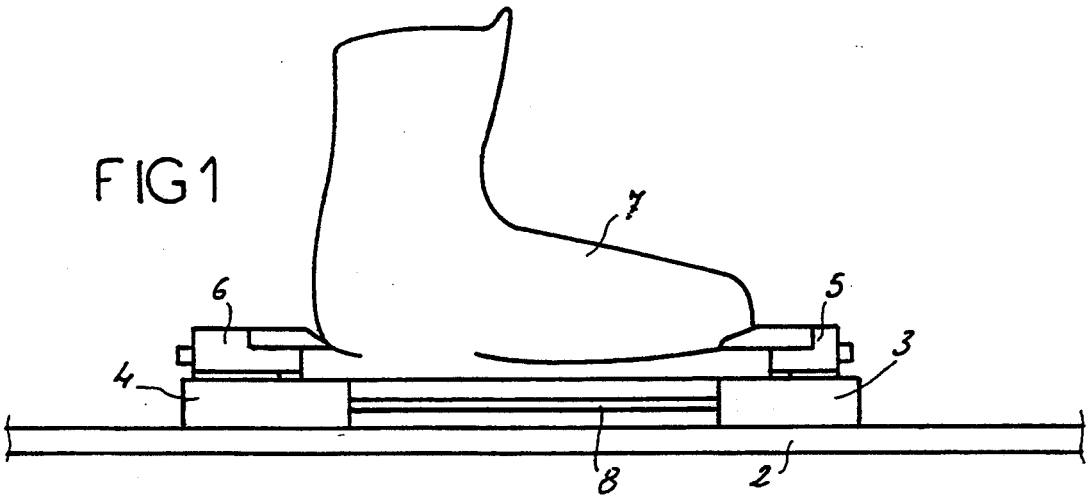
FIG. 1 is a side view of the central part of a ski and of a ski boot mounted thereon, with use of a first embodiment of the device according to the invention.

According to a first embodiment of the invention, the connector between the blocks includes at least one inextensible rod located longitudinally with respect to the ski, above the upper surface of said ski and below the upper surface of the blocks with a provision for allowing the two blocks to approach one another.

According to a further embodiment of the invention, at least one end of the rod is mounted in a block with a provision for sliding longitudinally in the block and abutting a stop located inside the block and facing the center of the boot.

Advantageously, each movable end of the rod has an enlarged part in the form of a piston slidably mounted inside a recess of a block in the form of a cylinder. The piston delimits the cylinder into two chambers of which the one chamber located beside the rod contains a hard viscoelastic material, while the other chamber contains a more flexible viscoelastic material.

In accordance with a further embodiment of the invention, the hard viscoelastic material preferably has a Young's modulus between $10^9$ and $10^{10}$ N/m$^2$, while the more flexible viscoelastic material preferably has a Young's modulus between $10^7$ and $10^8$ N/m$^2$. This arrangement makes the system practically inextensible with respect to the viscoelastic material. When the toe piece and the heel piece approach one another as a result of the deformation of the ski, the present invention permits an elastic damping of this deformation by compression of the viscoelastic material which is more flexible.

To promote the free flexing of the ski, the invention preferably has at least one of the ends of the rod mounted in a block with a provision for tilting relative to said block. This preferably is accomplished either by providing a vertical opening in the block to allow the rod to pass through or by articulating the rod inside the block around a horizontal axis parallel to the top surface of the ski and transverse to the axis of the ski.

According to another embodiment of the invention, a slab of viscoelastic material connected to the rod is mounted on the top surface of the ski, preferably about half way between the two blocks. Thus, when the ski flexes, the slab is stretched and compressed thereby damping the vibrations of the ski.

According to a further embodiment of the invention, a slab is mounted on the top surface of the ski with a plate of viscoelastic material interposed between the top surface of the ski and the slab. The slab includes a central opening to permit the passage of the rod. A ring of viscoelastic material is preferably interposed in the opening between the slab and the rod. Since the plate can be stretched and compressed and the ring can be subjected to shear, both participate in the damping of the deformation movements of the ski. This is quite favorable since, while the ski must not be prevented from deforming, at the same time, its deformations must be damped to limit the parasitic vibrations.

According to another embodiment of the invention, the rod is telescopic and each of its two ends is fixed to one of the two blocks. The two or more parts of the rod engaged in one another can include one or more stop made of viscoelastic material.

According to yet another embodiment of the invention, the connector between the two blocks includes at least one cable made of an inextensible material. The ends of the cable can be attached rigidly to the blocks. Alternately, a hard viscoelastic material can be interposed in at least one of the ends being attached to a block.

According to another embodiment of the invention the blocks are mounted on the top surface of the ski with plates of viscoelastic material interposed between the top surface of the ski and the blocks. These plates alone may suffice to permit the blocks to be drawn to one another elastically. The rod is then mounted without a provision for sliding with respect to the blocks. These plates can be used in combination with any of the embodiments of the invention.

FIG. 1 shows the central part or "skate" area 2 of a ski on whose top surface two blocks numbered 3 and 4 respectively are mounted. The two blocks are preferably made of rigid material. Block 3 preferably serves for mounting on a toe piece 5 and block 4 serves for mounting on a heel piece 6. Toe piece 5 and heel piece 6 are the binding for a ski boot 7.

In FIG. 1 and in other similar figures, the respective proportions of the ski, blocks, binding, and boot have not been perfectly represented in order to show the characteristics of the invention better.

Figure 2:
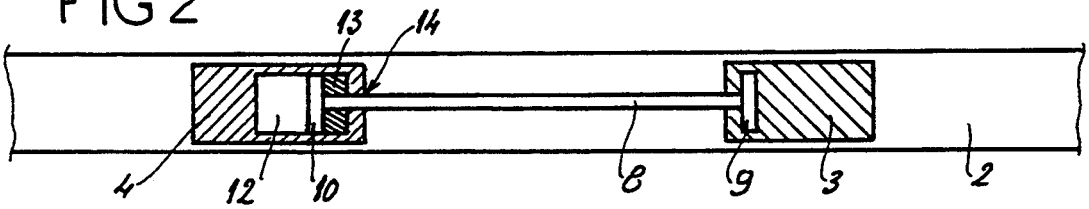
FIG. 2 is a schematic view from above with a horizontal section in the axis of the rod.

As shown in FIGS. 1 and 2, blocks 3 and 4 are connected by a rod 8 which is inextensible. Front end 9 of rod 8 is enlarged and anchored inside block 3. The rod's enlarged rear end 10 is located inside a cavity 12 provided in block 4. The rear end of rod 8 behaves like a piston, while the cavity 12 behaves like a cylinder. In the embodiment shown in FIG. 2, the piston on rod 8 abuts a rigid stop 13. Thus, when the boot 7 is mounted on the binding, the tilting forces exerted by the boot on the toe piece 5 and heel piece 6 of the binding do not result in excessive spreading of block 3 and block 4, thereby preventing excessive flexing of the ski.

Figure 3:
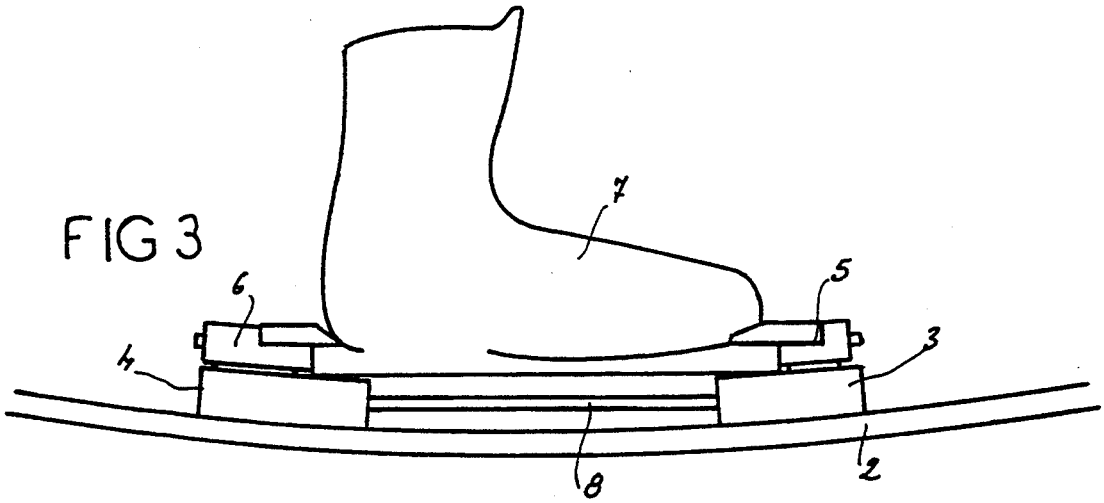
FIG. 3 is a side view of the device shown in FIGS. 1 and 2 during deformation of the ski.

On the other hand when, during use, the ski flexes as shown in FIG. 3, rod 8 does not interfere with this movement, since its rear end 10 can slide inside cavity 12 toward the rear thereof. To permit tilting of rear block 4 with respect to rod 8, an opening 14 is provided to allow rod 8 to pass through into the interior of block 4. It is further possible in accordance with the invention to replace this vertical opening 14 with a horizontal shaft mounted transversely to the length of the ski for mounting it on the front end 9 of rod 8 inside block 3.

Figure 4:
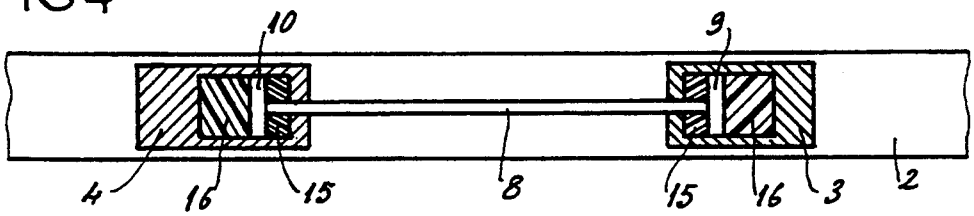
FIG. 4 is a view similar to FIG. 2 showing a variation of this device.

FIG. 4 shows a variation on the device shown in FIGS. 1 to 3 wherein the two ends of the rod 8 are mounted with a provision for sliding with respect to front block 3 and rear block 4. In addition, the cavities made inside the two blocks and arranged on either side of ends 9 and 10 respectively of rod 8 are filled with viscoelastic material. The viscoelastic material 15 located beside the rod is made of a hard substance that has a Young's modulus between $10^9$ and $10^{10}$ N/m$^2$. While the viscoelastic material 16 located on the other side of ends 9 and 10 is more flexible and has a Young's modulus between $10^7$ and $10^8$ N/m$^2$. Viscoelastic material 15 permits a firm contact but is not entirely rigid, permitting limitation of the distance between blocks 3 and 4. Viscoelastic material 16 allows blocks 3 and 4 to come closer together during a flexing movement of the ski, but at the same time, damps this movement to help keep the ski from vibrating.

Figure 5:
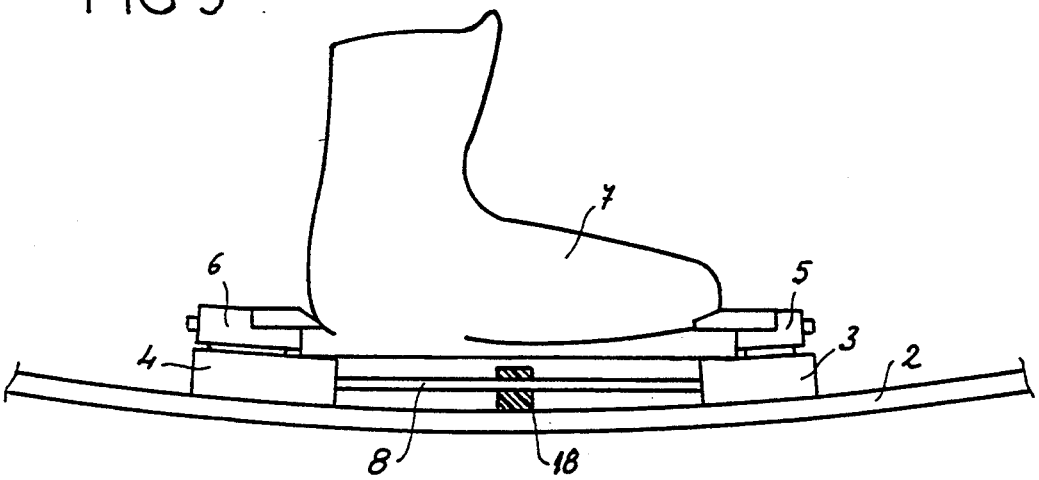
FIGS. 5 and 6 are two views corresponding to two embodiments of a supplement to the device in FIGS. 1 to 4.

In the embodiment shown in FIG. 5, a slab 18 of viscoelastic material is mounted on the top surface of the ski, preferably, halfway between blocks 3 and 4. When the ski flexes, the block 18 is stretched and compressed, damping the vibrations of the ski.

Figure 6:
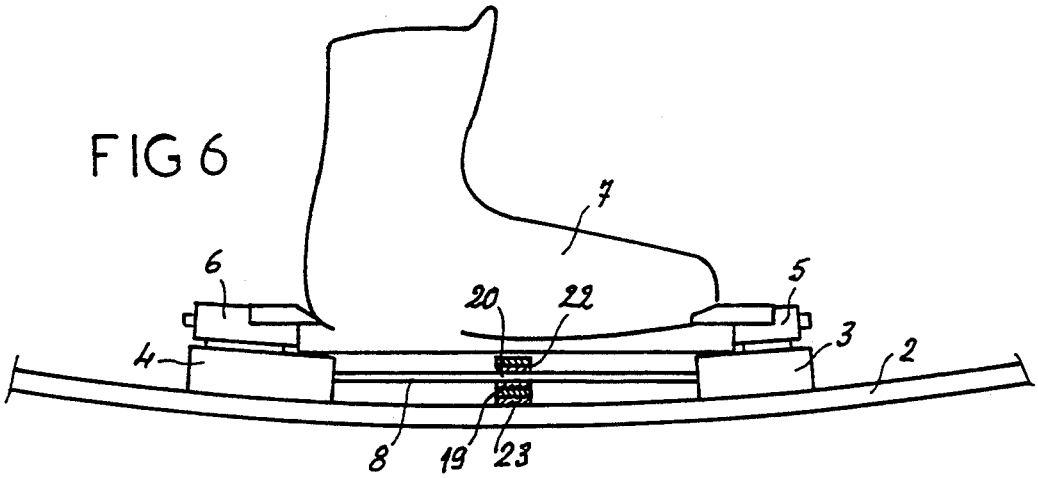

FIG. 6 shows a variation of the device in FIG. 5. In this case, a slab 19 is provided, made of a rigid material, that has a central and longitudinal opening 20 in which a ring 22 of viscoelastic material is mounted for surrounding rod 8. The slab is preferably glued to the rod at its central part. Slab 19 is mounted on the top surface of the ski by means of a plate of viscoelastic material 23. When the ski flexes the plate of viscoelastic material 23 is stretched and compressed, while ring 22 is subjected to shear.

Figure 7:
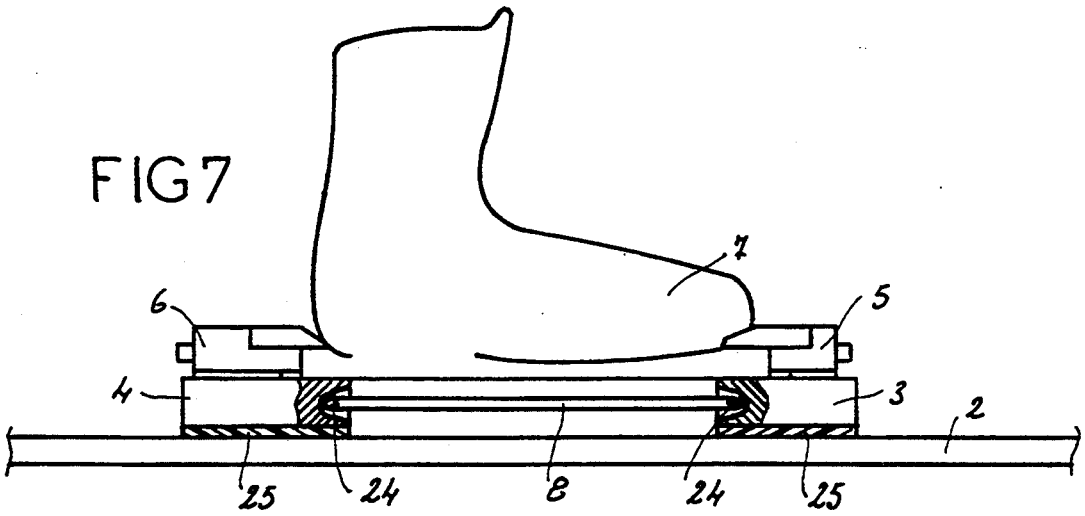
FIG. 7 is a view similar to FIG. 1 showing a variation of the embodiment of the device.

According to another embodiment shown in FIG. 7, rod 8 is mounted at its two ends on blocks 3 and 4 by two horizontal articulation shafts 24. The rod is parallel to the top surface of the ski and runs transversely with respect to the ski. The two blocks 3 and 4 preferably are mounted on the ski with a plate 25 of viscoelastic material interposed between the ski and the blocks. The two plates 25, during deformation of the ski, can slide relative to the two blocks 3 and 4 to ensure a damping action on the ski by absorbing the shear.

Figure 8:
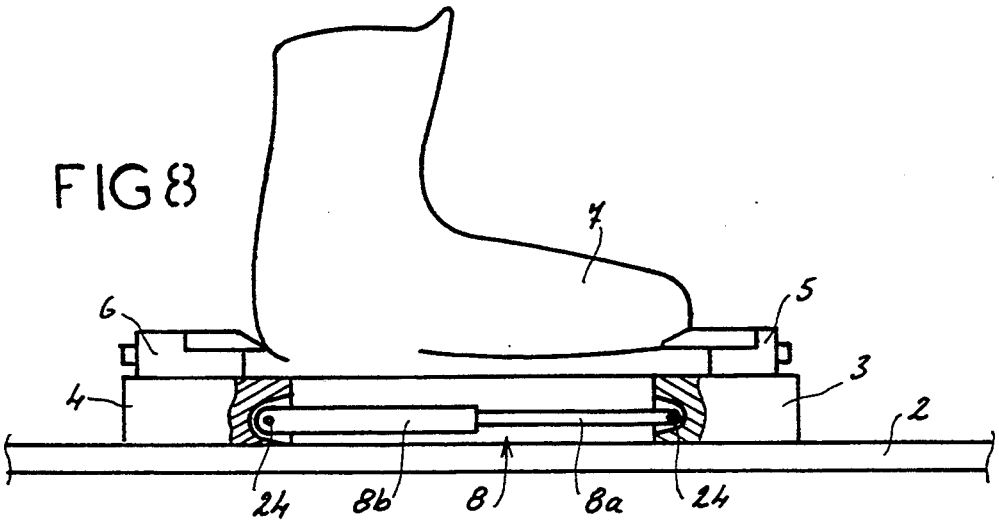
FIG. 8 is a view similar to FIG. 1 showing another embodiment of the device according to the invention.
Figure 9:
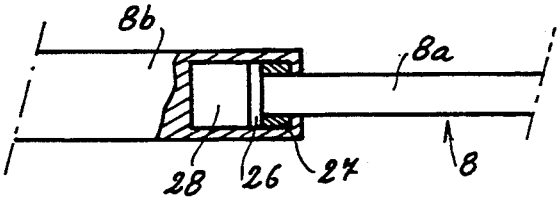
FIGS. 9 and 10 are two detailed views in partial section corresponding to two embodiments of the sliding means for the two telescopic parts of the rod of the device in FIG. 9.

In the embodiment shown in FIG. 8, rod 8 which has two ends articulated at 24 includes two telescoping parts **8*a* and 8*b*. Part 8*a* is able to slide inside part 8*b*. FIG. 9 shows a first embodiment where the boot is mounted on the ski. The end 26 of part 8*a* is adapted to be in contact with a stop 27. The end is further adapted to slide inside cavity 28 during a movement in which the two blocks 3 and 4** come closer together as a result of deformation of the ski.

Figure 10:
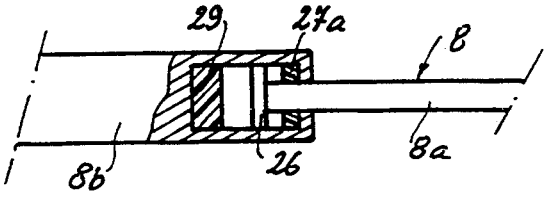

In the embodiment shown in FIG. 10, stop **27*a* is made of a hard viscoelastic material of a hardness corresponding to that indicated previously with reference to stop 15 in FIG. 4. The cavity 28 is partially filled with viscoelastic material 29 that is more flexible than viscoelastic material 27*a* and has a hardness comparable to viscoelastic material 16 defined with reference to FIG. 4**.

Figure 11:
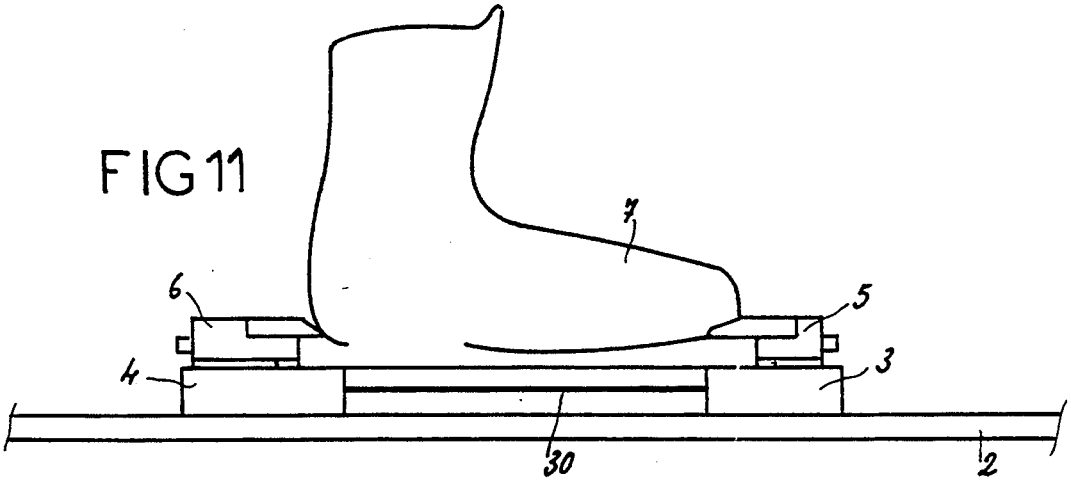
FIG. 11 is a view similar to FIG. 1 showing another embodiment of this device.
Figure 12:
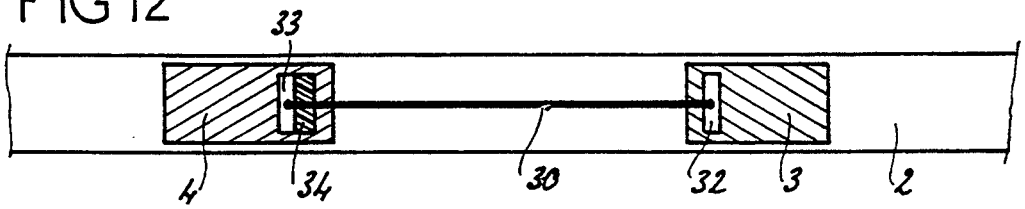
FIG. 12 is a view similar to FIG. 2 showing in a top view and in partial cross section in a horizontal plane the device in FIG. 11.
Figure 13:
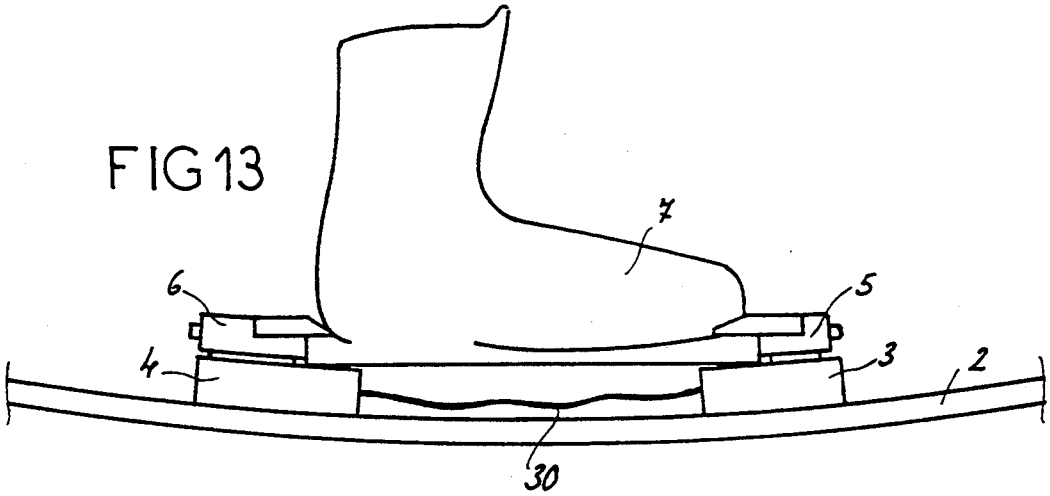
FIG. 13 is a side view of the device in FIG. 11 upon deformation of the ski.

FIG. 11 shows another embodiment of the invention, wherein the two blocks 3 and 4 are connected together by an inextensible cable 30, for example including but not limited to one made of stainless steel. The two ends of the cable can be attached in one embodiment in a rigid fashion to the two blocks 3 and 4. In another embodiment as shown in FIG. 12, the front end 32 of cable 30 can be attached in rigid fashion to block 3 while the rear enlarged end 33 of cable 30 can abut a high-hardness viscoelastic material 34. As shown in FIG. 13, when the ski is deformed in a direction that causes blocks 3 and 4 to come closer together, cable 30 slackens, thus having no harmful effect on the behavioral characteristics of the ski.

As the above indicates, the invention represents a considerable improvement in existing technology by supplying a device of simple design that allows raising the mounting surface of the toe piece and heel piece of a ski, while avoiding giving this ski excessive flexure that modifies its behavior.

While advantageous embodiments have been chosen to illustrate the invention, it will be understood by those skilled in the art that various changes and modifications can be made therein without departing from the scope of the invention as defined in the appended claims. For example, several characteristics described separately, or as specific combinations, can be combined in different ways without departing from the scope of the invention.

What is claimed is:

1. A device for mounting a binding on a ski comprising:

a pair of blocks, each block of said pair of blocks being independent from each other, said pair of blocks being mounted on a top surface of a ski, a toe piece and a heel piece of a binding being mounted on said pair of blocks, a connector extending between said pair of blocks for connecting said pair of blocks such that upon flexing of the ski said connector prevents said pair of blocks from spreading while permitting said pair of blocks to approach one another;

wherein said connector extending between said pair of blocks comprises at least one inextensible rod having first and second ends, said inextensible rod being located longitudinally on said ski above a top surface of said ski and below a top surface of said pair of blocks and allowing said pair of blocks to approach one another, wherein at least one of said first and second ends of said inextensible rod is mounted in at least one of said pair of blocks, said inextensible rod being longitudinally slidable in said pair of blocks and adapted for abutting a first stop located near an end of said pair of blocks which faces a middle part of a boot;

and wherein said first and second ends of said inextensible rod each have an enlarged part, each said enlarged part being in a form of a piston, said enlarged part being mounted inside a recess of one of said pair of blocks in a shape of a cylinder for sliding in said cylinder, said piston delimiting said cylinder into first and second chambers, said first chamber being located at an end of said pair of blocks near said inextensible rod and containing a hard viscoelastic material, said second chamber containing a more flexible viscoelastic material than said hard viscoelastic material.

2. A device in accordance with claim 1, wherein said hard viscoelastic material has a Young's modulus between $10^9$ and $10^{10}$ N/m$^2$, and said more flexible viscoelastic material has a Young's modulus between $10^7$ and $10^8$ N/m$^2$.

3. A device in accordance with claim 1, wherein at least one of said first and second ends of said inextensible rod is mounted in a respective said block in such a manner as to allow inclination of said at least one of said first and second ends relative to said block.

4. A device in accordance with claim 3, wherein at least one said block comprises a vertical opening for allowing the inextensible rod to pass through.

5. A device in accordance with claim 1, further comprising a slab of viscoelastic material connected to said inextensible rod, said slab being attached to said top surface of said ski substantially halfway between said blocks.

6. A device in accordance with claim 1, further comprising a slab mounted on said top surface of said ski by a plate of viscoelastic material, said slab comprising a central opening to allow said inextensible rod to pass through, said central opening having a ring of viscoelastic material mounted therein and said ring being connected to said inextensible rod.

7. A device in accordance with claim 1, wherein said inextensible rod is telescopic, and said inextensible rod comprises first and second telescopic parts articulated on respective ones of said pair of blocks.

8. A device for mounting a binding on a ski comprising:

a pair of blocks, each block of said pair of blocks being independent from each other, said pair of blocks being mounted on a top surface of a ski, a toe piece and a heel piece of a binding being mounted on said pair of blocks, a connector extending between said pair of blocks for connecting said pair of blocks such that upon flexing of the ski said connector prevents said pair of blocks from spreading while permitting said pair of blocks to approach one another, wherein said connector comprises at least one cable, said cable being made of an inextensible material.

9. A device in accordance with claim 8, said cable having first and second ends, said first and second ends being rigidly attached to respective ones of said pair of blocks.

10. A device in accordance with claim 8, wherein at least one of said first and second ends of said cable is mounted with a hard viscoelastic material on a respective one of said pair of blocks.

11. A device in accordance with claim 1, wherein said blocks are mounted on plates of viscoelastic material mounted on said top surface of said ski.

12. A device for mounting a binding on a ski comprising:

a pair of blocks, each block of said pair of blocks being independent from each other, said pair of blocks being mounted on a top surface of a ski, a toe piece and a heel piece of a binding being mounted on said pair of blocks, a connector extending between said pair of blocks for connecting said pair of blocks such that upon flexing of the ski said connector prevents said pair of blocks from spreading while permitting said pair of blocks to approach one another, wherein said connector extending between said pair of blocks comprises at least one inextensible rod having first and second ends, said inextensible rod being located longitudinally on said ski above a top surface of said ski and below a top surface of said pair of blocks and allowing said pair of blocks to approach one another, wherein said inextensible rod is telescopic, and said inextensible rod comprises first and second telescopic parts articulated on respective ones of said pair of blocks, and wherein said first and second telescopic parts of said inextensible rod fit into one another and are associated with stops, a first said stop being comprised of a viscoelastic material which limits the spreading of said blocks, and a second said stop being comprised of a viscoelastic material which limits the approach of said blocks toward one another, the viscoelastic material which limits the spreading of the blocks being made of a harder viscoelastic material than the viscoelastic material which limits the approach of said blocks toward one another.

13. A device for mounting a binding on a ski comprising:

a pair of blocks, each block of said pair of blocks being independent from each other, said pair of blocks being mounted on a top surface of a ski, a toe piece and a heel piece of a binding being mounted on said pair of blocks, a connector extending between said pair of blocks for connecting said pair of blocks such that upon flexing of the ski said connector prevents said pair of blocks from spreading while. permitting said pair of blocks to approach one another, wherein said connector extending between said pair of blocks comprises at least one inextensible rod having first and second ends, said inextensible rod being located longitudinally on said ski above a top surface of said ski and below a top surface of said pair of blocks and allowing said pair of blocks to approach one another, wherein at least one of said first and second ends of said inextensible rod is mounted in a respective said block in such a manner as to allow inclination of said at least one of said first and second ends relative to said block, and wherein at least one of said first and second ends of said inextensible rod is articulated to an interior of a respective said block by a horizontal shaft, said horizontal shaft being parallel to said top surface of said ski and transverse to a longitudinal axis of said ski.

* * * * *